US005704159A

United States Patent [19]

Dreyer et al.

[11] Patent Number: 5,704,159

[45] Date of Patent: Jan. 6, 1998

[54] STRUCTURAL INSERT FOR PROVIDING ROOT-SPACE PROTECTION

[75] Inventors: Hermann A. Dreyer, Luzernerstrasse 51, CH-4800 Zofingen; Peter Erlacher, Zofingen, both of Switzerland

[73] Assignee: Hermann A. Dreyer, Zofingen, Switzerland

[21] Appl. No.: 464,903

[22] PCT Filed: Nov. 9, 1994

[86] PCT No.: PCT/CH94/00218

§ 371 Date: Jul. 19, 1995

§ 102(e) Date: Jul. 19, 1995

[87] PCT Pub. No.: WO95/16077

PCT Pub. Date: Jun. 15, 1995

[30] Foreign Application Priority Data

Dec. 9, 1993 [CH] Switzerland ..... 3667/93

[51] Int. Cl.[6] ..... A01G 13/02

[52] U.S. Cl. ..... 47/25; 52/20

[58] Field of Search ..... 47/25; 52/19, 20, 52/245

[56] References Cited

U.S. PATENT DOCUMENTS

| | | | |
|---|---|---|---|
| 3,318,476 | 5/1967 | Clark | 52/220.1 |
| 3,858,998 | 1/1975 | Larsson et al. | 52/19 |
| 4,308,688 | 1/1982 | Revane | 47/25 |
| 4,627,191 | 12/1986 | Bergere | 47/25 |
| 4,858,378 | 8/1989 | Helmy | 47/25 |
| 4,986,025 | 1/1991 | Imperial | 47/25 |

FOREIGN PATENT DOCUMENTS

| | | | |
|---|---|---|---|
| 2673654 | 9/1992 | France | 52/20 |
| 2317216 | 10/1974 | Germany | 47/25 R |
| 2445721 | 4/1976 | Germany | 52/20 |
| 2212903 | 10/1977 | Germany | 52/20 |
| 86 08 185 U | 3/1986 | Germany . | |
| 88 05 141 U | 6/1988 | Germany . | |
| 40 09 612.2 | 10/1990 | Germany . | |
| 40 09 613.0 | 10/1990 | Germany . | |
| 90 14 587 U | 1/1991 | Germany . | |
| 2247037 | 2/1992 | United Kingdom | 52/20 |

*Primary Examiner*—Terry Lee Melius
*Assistant Examiner*—Joanne C. Downs
*Attorney, Agent, or Firm*—Karl Hormann

[57] ABSTRACT

The root-space protection comprises a basic component (1) forming the root space and a cover (9) with a trunk aperture. In order to suit the root-space protection to the biological, technical and aesthetic requirements, the proposal is for a structural insert in which the basic component (1) is subdivided transversely to its vertical axis (2) into at least two parts (3, 4), where the upper part has a recess (5) for the cover.

8 Claims, 2 Drawing Sheets

STRUCTURAL INSERT FOR PROVIDING ROOT-SPACE PROTECTION

The invention relates generally to a plant root protector and, more particularly, to a protector provided with a plurality of frame-shaped members which may be stacked on top of each other substantially in parallel or in any desired angular inclination.

A root space protector (also known as a tree ring) comprises a foundation frame (also called basic element) sinkable into the soil, into which a tree including its root may be planted and which will protectively surround a root. In the area of the traffic surface surrounding the tree, the basic element is provided with a frame into which a cover made up of at least two parts and provided with an opening surrounding the tree may be inserted after the tree has been planted. The cover is made up of components which may be put together in the manner of a jig-saw puzzle. In the cover of the root-space protector disclosed by German Published Patent Specifications 40 09 612 and 40 09 613 the components, when they are being inserted into the frame, may be put together in different ways and may be rotated relative to each other, thereby allowing to select the eccentricity of the trunk opening. However, this root-space protector suffers from the dis-advantage, that size and, in particular, depth of its basic element are preset and cannot be changed. The root exit openings in the wall of the basic element are preset as well. Hence, the protective root space cannot be adjusted to the shape of the root of a tree which impedes its growth. Also, the depth at which the roots may laterally penetrate through the basic element cannot be adjusted to conform to the requirements of a road building engineer, thus giving rise to the danger that individual tree roots will penetrate at too shallow a depth and raise the road pavement.

For the purpose of avoiding these disadvantages a root space protector is known the basic element of which is constructed of concrete beams of rectangular cross section. During erection or construction parallel pairs of beams are placed in superposition on the planar bottom of a hole, each rotated by 90° in the manner of log-cabin construction, until the basic element has attained its desired height. Where roots are not allowed to penetrate the open sections in the four walls, the basic element will be closed by somewhat smaller beams of like cross section. This basic element suffers from a low inherent stability and in the long run might not be able adequately to absorb the traffic load affecting it. Therefore, the cover is supported by a foundation made up of posts surrounding the basic element, for which reason a frame member for receiving the cover is affixed on top of the posts. Furthermore, the basic element cannot protrude above the traffic surface to form a curb stone.

With all of these known devices for protecting the root space the part visible after installation can be conformed to the style of the surrounding traffic surface in a limited way only.

It is, therefore, the task of the present invention to provide means with which a root space protector may be made without the disadvantages referred to and with which the inclination of the cover can easily be conformed to the surrounding traffic surface.

In accordance with a currently preferred embodiment, the invention provides for a root protector provided with a basic element which defines a three-dimensional root-space and which is composed of at least first and second components in superposition and each consisting of at least two substan-tially complementarily configured members connected to each other and disposed to surround the root-space, the uppermost component defining a frame adapted to receive cover means defining an opening for receiving a plant trunk.

The invention will be described by way of example on the basis of the enclosed schematic drawing, in which.

Figure 2A:
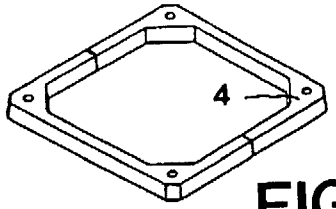
FIG. 2 and 3 depict different embodiments of the basic element that may be made with the set of structural components, with the uppermost component providing the frame eliminated.
Figure 2B:
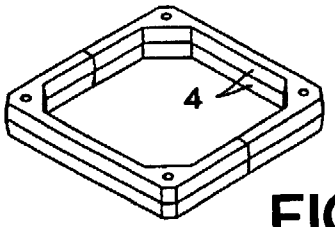
Figure 2C:
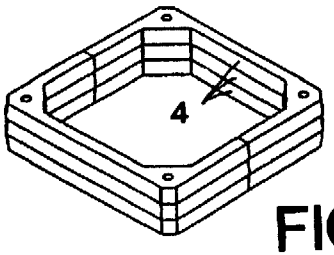
Figure 2D:
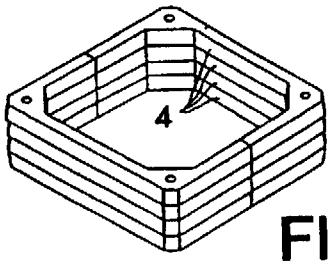
Figure 1:
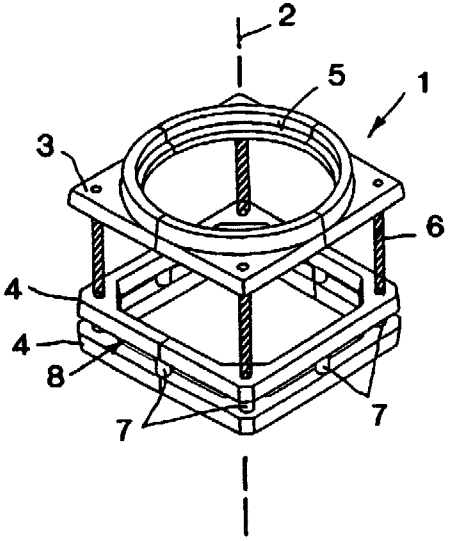
FIG. 1 depicts a basic element composed of several structural- components.
Figure 3:
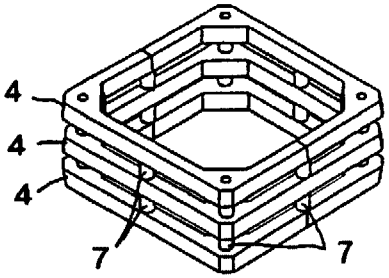

The basic element 1 shown in FIG. 1 is divided into three components 3, 4 along its vertical axis 2. The lower two components are alike whereas the uppermost component 3 is shaped differently and is provided with a frame 5 into which a cover (FIG. 6) may be inserted. Four threaded shafts 6 connect the uppermost component 3 to the component 4 positioned therebelow. The distance between these two components 3, 4 is adjustable by nuts (not shown) threaded onto the threaded shafts 6. By adjusting these nuts the inclination of the uppermost component 3 may be changed relative to the vertical axis and may be rendered conforming to the adjacent traffic area. Spacers 7 separate the lower components 4 and form openings 8 through which the roots of a planted tree may grow into the surrounding soil. As shown in FIG. 2, one or more frame shaped components 4 may be placed beneath the uppermost component 3, according to the depth desired for the basic element 1. Where no lateral root penetration is desired for the entire depth, the components 4 are directly placed on top of each other (FIG. 2*b* to 2*d*); otherwise spacers 7 will be placed between the components 4 (FIG. 3). But where root penetration must not occur above a certain depth below the traffic surface (for instance, in order to prevent buckling of the surface area because of tree roots), the components 4 will be placed directly on top of each other up to this depth and only at a greater depth will they be separated by the spacers 7.

Figure 4A:
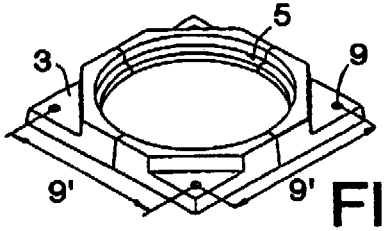
FIG. 4 depicts the basic element of FIG. 1 with different frame components.
Figure 4B:
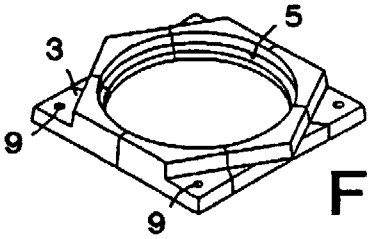
Figure 4C:
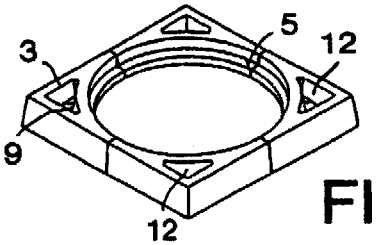
Figure 4D:
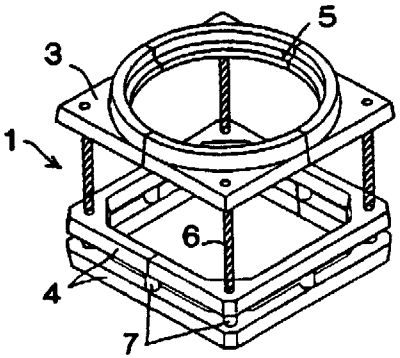

FIG. 4*d* shows the same basic element as FIG. 1. In order stylistically to conform its appearance to the environment of the tree, different embodiments of the uppermost component 3 may be provided. FIG. 4*a* to 4*c* show octagonal, hexagonal and square frame shapes for the cover. Regardless of their shape, in all uppermost components 3 the distances 9' between the guide openings 9 for the threaded shafts 6, as well as the shape of the frames 5, are alike. Accordingly, any one of the components shown in FIG. 4 may be selected to be mounted on the components 3 by means of the threaded shafts 6.

Figure 5A:
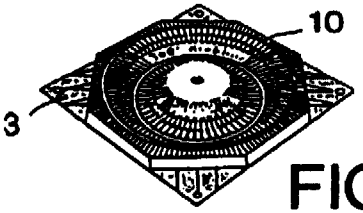
FIG. 5 depicts further embodiments of the frame component of the basic element with a cover inserted into the frame.
Figure 5B:
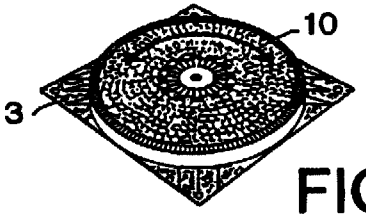
Figure 5C:
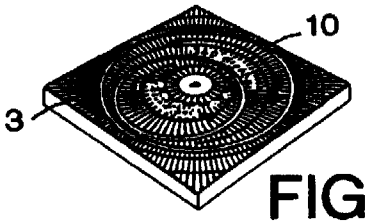

Instead of concrete, the components 3 may also be made of cast iron or another material and may be made to conform to the environment of the tree. The same holds true for the cover 10, which in FIG. 5*a* and 5*c* is made of cast iron and in FIG. 5*b* is laminated with a layer of cobble stones.

Figure 6A:
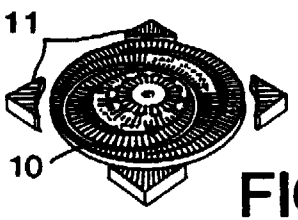
FIG. 6 depicts further embodiments of the cover.
Figure 6B:
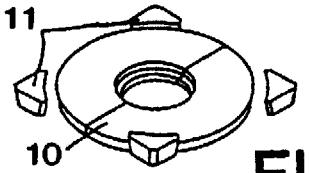

FIG. 6*a* and 6*b* respectively show cast iron and concrete covers. Aside from the covers 10 corner ornaments 11 have been depicted which may be utilized as shown in FIG. 4*c* in connection with component 3. With that component (FIG. 4*c*), these corner ornaments 11 will be chosen in stylistic conformity with the cover 10 inserted into the frame 5, and will be inserted into corresponding recesses 12 flush with the surface of the basic element.

The frame shaped components 3 and 4 may be composed of two or four segments which are radially symmetrical relative to the vertical axis 2. This holds true also for the cover 10 which must be made up of at least two segments.

Even though the number of structural components is relatively small, many tree rings differing in their depth, the position of their root openings, their appearance and their inclination relative to a traffic surface may be made. Moreover, the set of structural components offers the advantage of its appearance being easily adjustable to conform to changes in fashion, in that only components 3 and the cover 10 need be adjusted to confrom to a new fashion.

What is claimed is:

1. A structural component set for defining a plant root space protector, comprising:

basic element means defining a three-dimensional root space and including an upper component and a lower component, said lower component comprising a plurality of substantially identical members, said upper component and said lower component including said substantially identical members being adapted to be placed in superposed relationship at selectable distances from each other along a substantially vertical axis, said upper component and said lower component including said substantially identical members comprising a plurality of connectable frame members and defining openings surrounding said substantially vertical axis, the opening of said upper component being adapted to receive cover means defining a frame for a plant trunk; and a plurality of individually adjustable spacer means, said spacer means being arranged between said upper component and said lower component and comprising threaded bolt means and nut means rotatably received thereon, for defining said selectable distances between said upper component and said lower component including said substantially identical members thereof.

2. The structural component set according to claim 1, wherein said upper component and said lower component including said substantially identical members thereof are shaped like substantially rectangular frames.

3. The structural component set according to claim 2, wherein said substantially identical members of said lower component are of substantially the same height.

4. The structural component set according to claim 3, wherein said upper component and said cover means are made of different materials.

5. The structural component set according to claim 3, wherein said upper component and said cover means are made of the same material.

6. The structural component set according to claim 5, wherein said upper component and said lower component are made of different materials.

7. The structural component set according to claim 5, wherein said upper component is made of the same material as said lower component.

8. The structural component set according to claim 7, wherein said basic element means comprises a plurality of substantially symmetrical segments separated relative to a plane of symmetry including said substantially vertical axis.

* * * * *